US005203531A

United States Patent [19]

Gracon

[11] Patent Number: 5,203,531

[45] Date of Patent: Apr. 20, 1993

[54] PAPER CUP STACK HOLDER

[76] Inventor: Edward Gracon, 7 Francis St., Derby, Conn. 06418

[21] Appl. No.: 843,759

[22] Filed: Feb. 28, 1992

[51] Int. Cl.[5] ..... A47K 1/08

[52] U.S. Cl. ..... 248/311.3; 206/49.9; 206/515; 211/49.1; 211/71

[58] Field of Search ..... 248/311.3, 176, 177, 248/311.2; 206/499, 515; 211/49.1, 71; 221/312, 226, 227, 241, 242; D7/400; D6/516

[56] References Cited

U.S. PATENT DOCUMENTS 1,171,538 2/1916 Pike ..... 248/311.3
1,213,685 1/1917 Owens ..... 248/311.3 X
1,398,030 11/1921 Luellen ..... 206/499
3,160,274 12/1964 Pritchard ..... 206/499 X

*Primary Examiner*—Ramon O. Ramirez
*Attorney, Agent, or Firm*—S. Pal Asija

[57] ABSTRACT

This invention relates to improved devices for holding a stack of light tapered paper cups such that the stack is not easily knocked down by wind, accidentally or otherwise. A series of embodiments are disclosed for fixed size of cups as well as adjustable types such that small as well as large cups can be stacked and short and tall stacks can be accommodated. The stationary fixed model comprises a conical base unit with a low center of gravity and a larger diameter at the bottom. An embodiment of the adjustable type comprises a base unit and plurality of adjustable prongs such that cups of different sizes can snugly fit.

8 Claims, 2 Drawing Sheets

PAPER CUP STACK HOLDER

BACKGROUND the problem with prior art paper cup holding and dispensing devices is that they are cumbersome, expensive and not practical for use in home or by a small business establishment. A formal prior art search was conducted but the inventor is aware of the following U S patents.

a) Utility U.S. Pat. No. 3,435,988 for paper cup dispenser.

b) Design U.S. Pat. No. 307,842 also for a paper cup dispenser.

c) Utility U.S. Pat. No. 4,854,479 for Adjustable Cup Dispensing Assembly.

d) Utility U.S. Pat. No. 5,014,878 for Flexible Cup Dispensing Apparatus.

e) Utility U.S. Pat. No. 4,919,587 for an apparatus for separating and transferring soft cups.

f) Design U.S. Pat. No. 250,804 for coffee filter paper cup holder.

Unfortunately none of the prior art devices singly or even in combination meet all of the objectives established by the inventor for this tongue hygiene system as follows.

OBJECTIVES

1. It is an objective of this invention is to provide an a portable paper cup stack holder.

2. Another objective of this invention is that device be cost effective and affordable for use at home or small business establishments.

3. Another objective of this invention is that the device be stable enough that it can be used in picnics and other windy outdoor conditions.

4. Another objective of this invention is that it be suitable for people of all ages, heights and gender.

5. Another objective of this invention is that it be aesthetic in appearance.

6. Another objective of this invention is that it be long lasting and reliable.

7. Another objective of this invention is to provide a dust proof cover.

8. Other objects of this invention reside in its simplicity, elegance, ease of manufacture, service and use and even aesthetics as will become apparent from the following brief description of the drawing and detailed description of the preferred embodiment.

SUMMARY

An embodiment of this invention comprises a conical base unit with a low center of gravity and a larger diameter at the bottom. This configuration can pack groups of stacks very closely with maximum positive stability.

Another embodiment of this invention comprises a base unit and plurality of adjustable prongs such that cups of different sizes can snugly fit. A triangular, circular, square, elliptical, or rectangular base of sheet metal or molded plastic with feet at corners that gives three or more point stability and is made of material that does not scratch the supporting surface.

In the base there are three slots with radial symmetry. The slots are in a direction from the center of the base to the corners with optional grooves upon the slots, such that the wide triangular base may accommodate prongs of various types, sizes and shapes. The inventor has discovered that the triangular base gives the most stability using the least amount of material., but other bases are also satisfactory.

BRIEF DESCRIPTION OF THE DRAWING a) FIG. 1 is a perspective view of the fixed size stationary paper cup stack holder of this invention shown with a plurality of paper cups.

b) FIG. 2 is perspective view of the fixed size stationary paper cup stack holder of this invention without the stack of cups.

c) FIG. 3 is a mid sectional plan view of the fixed size stationary paper cup stack holder along the lines 3—3 of FIG 2.

d) FIG. 4 is a perspective view of the adjustable type paper cup stack holder.

e) FIG. 5 is a detailed perspective view of one of the plurality of prongs of the adjustable type paper cup stack holder along the lines 5—5 of FIG. 4.

f) FIG. 6 is a perspective view of another embodiment of adjustable type paper cup stack holder and its relationship to the bottom most cup in an inverted stack.

g) FIG. 7 is a detailed close up perspective view of one metal spring clips used in the alternate embodiment of FIG. 6.

h) FIG. 8 shows an exploded perspective view of another embodiment of an adjustable prong with a metal clip.

DETAILED DESCRIPTION OF THE PREFERRED EMBODIMENT

Figure 1:
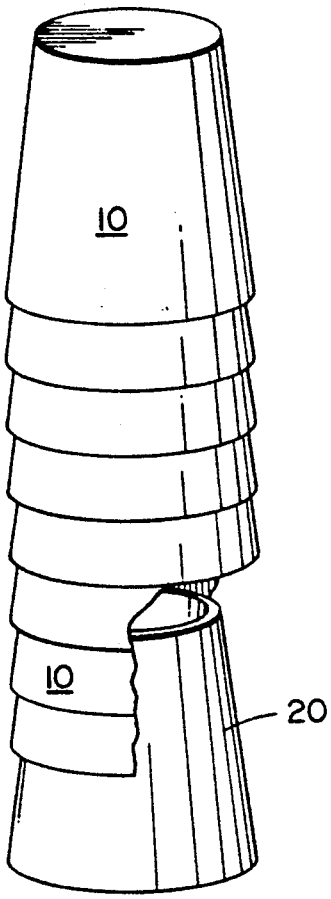
Figure 2:
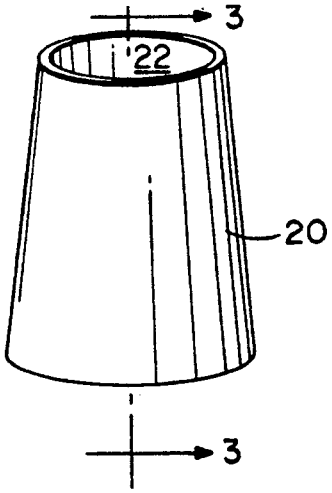
Figure 3:
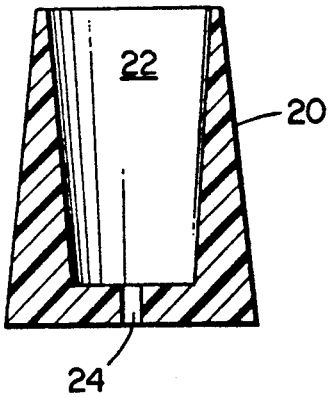

As shown in FIGS. 1 through 3 an embodiment of this invention comprises a conical base unit 20 with a low center of gravity and a larger diameter at the bottom. The low center of gravity is obtained by making the base heavier or by making the top lighter which is done most economically by incorporating a cavity 22 of reverse taper on the top portion of said conical base unit 20. In the center along the vertical axis is provided a hole 24 to facilitate anchoring the base unit to a counter top or the like surface where a stack of cups is desired. Such an embodiment is suitable for cups of same fixed uniform same size only.

Figure 4:
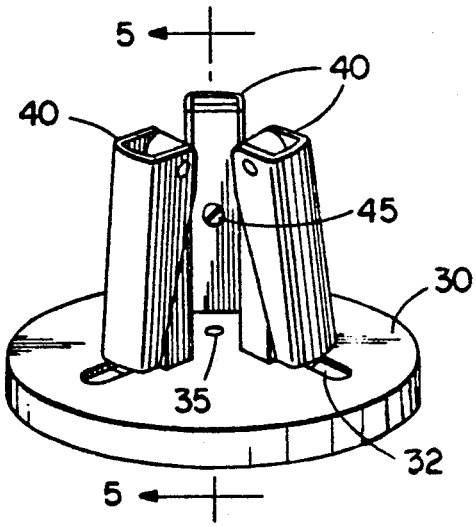
Figure 5:
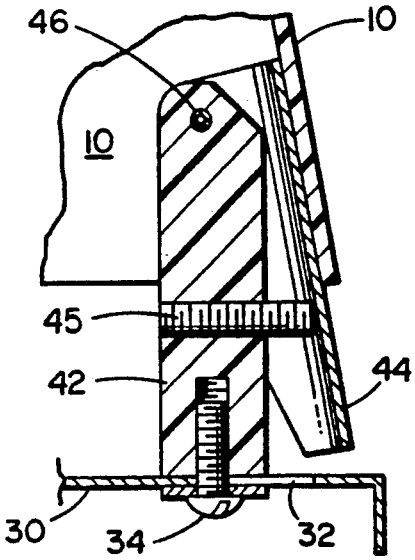

This deficiency is overcome in another embodiment of this invention shown in FIGS. 4 and 5 which comprises a circular disk base unit 30 and plurality of adjustable prongs 40 such that cups of different sizes can snugly fit. FIG. 5 shows a detailed view of one of the prongs 40. The base unit 30 also has plurality of radial slots 32. In the preferred embodiment the inventor used 3 symmetrical radial slots each displaced 120 degrees from the other two.

As shown in FIG. 4 since the prongs are in slots which are themselves 120 degrees apart, the prongs also retain the 120 degree orientation at every symmetrical position in the slot. 120 degrees orientation is maintained throughout the slots because 360 degrees of a circle are divided equally by three prongs one each in three slots.

Each prong 40 in turn comprises an anchoring unit 42 and a sleeve unit 44 which is connected to said anchoring unit via hinge 46. The prong 40 is mounted on the base unit 30 via a screw 34 which screws into anchoring unit via slot 32. In the preferred embodiment the inventor used three prongs one for each of the slots in the base unit.

While screw 34 can be used to adjust and lock the position of the prong to match the size of the cups, another screw 45 is also provided in the anchoring unit to adjust the angle between the anchoring unit 42 and sleeve unit 44 so as to match the shape of the cup.

The bottom of the base unit 30 is recessed to give clearance for the screw 34 so as to avoid scratching the surface of the supporting structure. The configuration of the recess comprises a lip on the disk to impart maximum stability.

The base unit 30 also includes a hole 35 at the center of the base 30 so that it may be screwed into the supporting structure to establish position and positive stability. In this embodiment the sleeve 44 of the anchoring unit 42 of the finger prong 40 is made of separate piece of material with flanges such that a pin 46 that goes through the upper part of the flanges and the upper part of the anchoring unit 42 allows the finger prong to pivot to imitate the angle of the side of the tapered cup 10.

Figure 6:
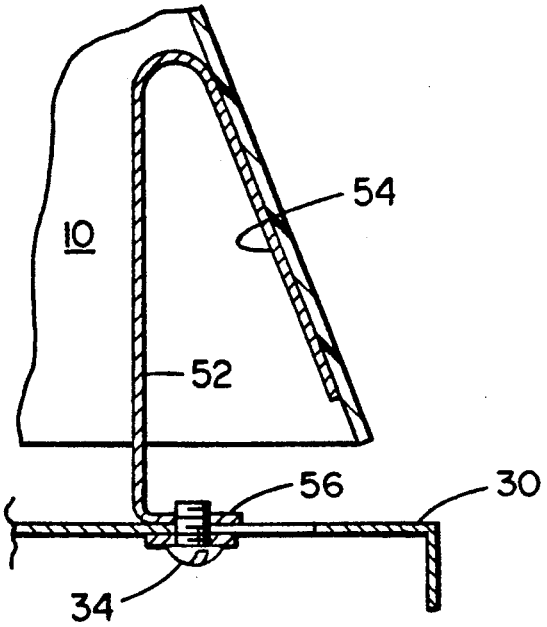
Figure 7:
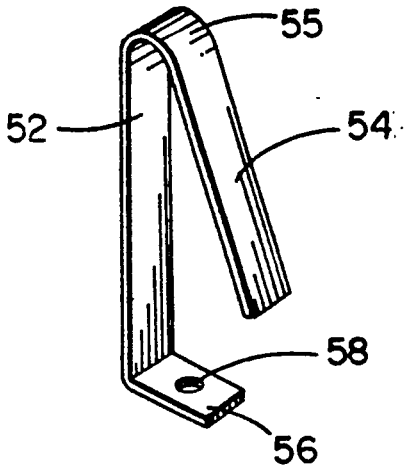

FIGS. 6 and 7 show an alternate embodiment where in sleeve is integral part of the anchoring unit, such that the uppermost portion 55 serves as a hinge spring, so as to enable the slanted angled portion 54 to pivot to imitate the angle of the side of the cup 10.

In this embodiment each prong comprises a one piece hardened sheet metal clip having a horizontal portion 56, vertical portion 54 and angled portion 54. The horizontal portion also has a hole 58 which connects the prong 40 to the base unit 30 in slot 32 via screw 34.

Adjustment to the size of the cup is again achieved by anchoring the prong 40 to the base unit 30 at the desired position in the slot.

For best results all three prongs are positioned symmetrically from the center of the base. The crude adjustment to match the shape of the cup is accomplished by bending the angled portion 54 with respect to the vertical portion 52 of the clip top the desired shape.

Figure 8:
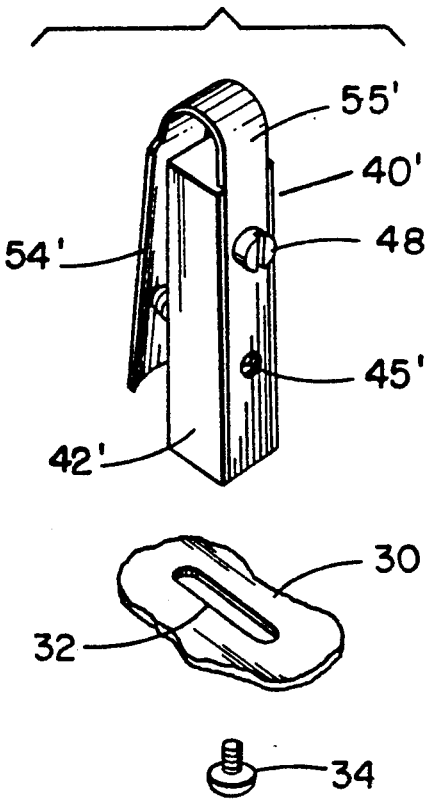

FIG. 8 shows an alternate embodiment of an adjustable prong 40' wherein a fastener 48 is used to connect clip 55' onto post 42'. As in other embodiments a fastener 34 is used to fasten prong 42' to base 30 via slot 32. The slant 54' is adjusted by screw 45' to match the shape of the cups.

OPERATION a) To use this device one simply adjusts the position of the prongs by adjusting screws 34 to match the size of the inverted cup if the embodiment incorporated this feature.

b) Similarly one adjusts the screw 45 to match the shape of the cup, if the embodiment incorporated this feature.

c) The unit is then placed and or anchored to the desired location.

d) Plurality of cups are then stacked upside down on the device.

e) Remaining cups are then stacked also upside down to the desired height.

f) The cups are used by removing them from the top one at a time.

g) As the stack gets small it is again restacked by using the procedure of step e) supra.

The inventor has given a non-limiting description of the preferred and alternate embodiments. Many changes may be made to this design without deviating from the spirit of this invention. Examples of such contemplated variations include the following.

a) The devices may be adapted for paper plates or like devices.

b) The shapes and sizes of the devices and base units may be varied.

c) The device may be adapted for cups made of different materials for example plastic cups, styrofoam cups etc.

d) The shape of the prongs may be modified without deviating from their essential characteristic of snugly receiving cups of many different sizes.

e) The cavity in the conical unit may be changed in size or shape.

Following is a listing of the components used in the preferred and alternate embodiment arranged in ascending order of the reference numerals for ready reference of the reader.

10=a cup in a stack
20=Conical stationary unit
22=Cavity in the conical stationary unit
24=Vertical slot in the conical unit for u to a counter top or other surface with a screw.
30=Base unit for adjustable embodiments
32=Slot in the base unit
34=Screw for adjusting prong 40 to size of the cups.
35=Hole in the base 30
40=Adjustable prong
40'=Alternate embodiment of an adjustable prong
42=Anchoring unit of prong 40
44=Sleeve unit of prong 40
45=Screw arrangement for adjusting prong to shape of cups.
45'=Alternate embodiment of screw arrangement for adjusting prong to shape of the cups.
46=Hinge between sleeve unit 44 and anchoring unit 42 of prong 40
48=Screw for anchoring clip 55' in prong alternate embodiment.
50=Alternate embodiment of prong shown in FIG. 7
52=Vertical portion of prong 50
54=Slanted angled portion of prong 50
55=Hardened Sheet Metal clip as Hinge Spring
55'=Alternate embodiment of a spring for use with prong 40'
56=Horizontal portion of prong 50
58=Hole in horizontal portion of prong 50

While this invention has been described with reference to illustrative embodiments, this description is not intended to be construed in a limiting sense. Various modifications and combinations of the illustrative embodiments as well as other embodiments of the invention will be apparent to person skilled in the art upon reference to this description. It is therefore contemplated that the appended claims cover any such modifications, embodiments as fall within the true scope of the invention.

The inventor claims:

1. A paper cup stack holder and dispenser comprising:

a) a base unit;

b) a prong unit means for adjusting to the size of the cups adjustably connected to said base unit; and c) a prong unit sleeve means for adjusting to the shape of said paper cup.

2. A paper cup stack holder and dispenser of claim 1 wherein further:

a) said base unit comprises a plurality of slots for adjustably connecting said prong unit means to said base unit;

b) said prong unit comprises an anchoring unit connected to said base unit via a screw and a sleeve unit hingedly connected to said anchoring unit; and c) relative angle between said anchoring unit and said sleeve unit can be altered merely by screwing and unscrewing a screw connected to said anchoring unit.

3. A paper cup stack holder and dispenser of claim 2 wherein three prongs are connected to said base unit each 120 degrees apart radially.

4. A paper cup stack holder and dispenser of claim 1 wherein:

a) said base unit comprises a plurality of slots for adjustably connecting said prong unit means to said base unit;

b) said prong unit comprises a resilient clip having a horizontal portion with a hole, a vertical portion and a slanted angled portion; and wherein c) the angle between the slanted portion and the vertical portion can be adjusted manually within the elastic limits of said resilient clip.

5. A paper cup stack holder and dispenser of claim 4 wherein three prongs are connected to said base unit each 120 degrees apart radially.

6. A paper cup stack holder and dispenser comprising:

a) a base unit having a plurality of radial slots symmetrically arranged;

b) a prong unit comprising an anchoring nit connected to said base unit via a first screw and a sleeve unit hingedly connected to said anchoring unit; and c) a second screw laterally connected to said anchoring unit for adjusting relative angle between said anchoring unit and said sleeve unit merely by screwing and unscrewing said second screw.

7. A paper cup stack holder and dispenser comprising:

a) a base unit having a plurality of radial slots symmetrically arranged;

b) a plurality of resilient clips connected to said base unit each said clip having a horizontal portion with a hole, a vertical portion and a slanted angled portion; and wherein c) the angle between the slanted portion and the vertical portion can be adjusted manually within the elastic limits of sail resilient clips.

8. A paper stack holder and dispenser of claim 7 wherein three prongs are connected to said base unit each 120 degrees apart radially.

* * * * *